US005194099A

United States Patent [19]

Esper et al.

[11] Patent Number: 5,194,099

[45] Date of Patent: Mar. 16, 1993

[54] SINTER MAGNET BASED ON FE-ND-B

[75] Inventors: Friedrich Esper, Leonberg; Waldemar Draxler, Korntal; Günter Petzow, Leinfelden; Andreas Büchel; Klaus-Dieter Durst, both of Stuttgart; Ernst-Theo Henig, Leonberg; Gerhard Schneider, Stuttgart; Helmut Kronmüller, Korb, all of Fed. Rep. of Germany

[73] Assignees: 501 Max-Planck-Gesellschaft zur Forderung der Wissenschaften E.V., Gottingen; 502 Robert Bosch GmbH, Stuttgart, both of Fed. Rep. of Germany

[21] Appl. No.: 466,457

[22] PCT Filed: Oct. 28, 1988

[86] PCT No.: PCT/EP88/00978

§ 371 Date: May 23, 1990

§ 102(e) Date: May 23, 1990

[87] PCT Pub. No.: WO89/05031

PCT Pub. Date: Jun. 1, 1989

[30] Foreign Application Priority Data

Nov. 26, 1987 [DE] Fed. Rep. of Germany ..... 3740157

[51] Int. Cl.[5] ..... H01F 1/053

[52] U.S. Cl. ..... 148/302; 148/101; 148/104; 419/12; 419/19; 419/20; 75/233; 75/244

[58] Field of Search ..... 148/101, 102, 103, 104, 148/302; 419/12, 19, 20; 75/233, 244

[56] References Cited

U.S. PATENT DOCUMENTS

| | | | |
|---|---|---|---|
| 4,588,439 | 5/1986 | Narasimban et al. | 148/302 |
| 4,601,875 | 7/1986 | Yamamoto et al. | 419/23 |
| 4,762,574 | 8/1988 | Ghandehari | 148/103 |
| 4,770,723 | 9/1988 | Sagawa et al. | 148/302 |
| 4,826,546 | 5/1989 | Yamamoto et al. | 148/102 |
| 4,834,812 | 5/1989 | Ghandehari | 148/101 |
| 4,954,186 | 9/1990 | Ghandehari | 148/302 |

FOREIGN PATENT DOCUMENTS

| | | | |
|---|---|---|---|
| 0208807 | 1/1987 | European Pat. Off. . | |
| 0255939 | 2/1988 | European Pat. Off. | 148/302 |
| 3637521 | 5/1988 | Fed. Rep. of Germany | 419/12 |

OTHER PUBLICATIONS

IEEE Trans. on Magnetics, vol. MAG23 No. 5, part 1, Sep. 1987, J. Fidler, "On the Role of Nd-Rich Phases in Sintered Nd-Fe-B Magnets", pp. 2106-2108.

Patent Abstracts of Japan, vol. 11, No. 359 (E-559)(2806), Nov. 21, 1987, JP 62-134907.

Patents Abstract of Japan, vol. 11, No. 245 (E-531)(2692), Aug. 11, 1987, JP 62-60207.

Patent Abstracts of Japan, vol. 11, No. 92 (E-491)(2539), Mar. 24, 1987, JP-61-24505.

Patent Abstracts of Japan, vol. 11, No. 117 (E-498)(2564), Apr. 11, 1987, JP-61-263201.

Ghandehari, "Reactivity $Dy_2O_3$ and $Tb_4O_7$ with $Nd_{15}Fe_{77}B_8$ Powder and the Coercivity of the Sintered Magnets", Appl. Phys. Lett., 48(8), Feb. 24, 1986, pp. 548-550.

Ghandehari, "Microstructural Evidence for the Magnetic Surface Hardening of $Dy_2O_3$-Doped $Nd_{15}Fe_{77}B_8$ Magnets", Materials Letter, Jul., 1987, vol. 5, pp. 285-287.

*Primary Examiner*—John P. Sheehan

[57] ABSTRACT

A sinter magnet based on Fe-Nd-B with improved coercive field strength and reduced temperature dependency thereof consists of 25 to 50 wt. % Nd, 0.5 to 2 wt. % B, 0 to 5 wt. % Al, 0.5 to 3 wt. % O, remainder Fe and usual impurities and has an oxygen content which is adjusted by the addition of oxygen or of oxygen-containing compounds, especially of an Al and/or Nd oxide, before the dense sintering. It is obtainable by the melting together of the pure components with formation of a pre-alloy, pulverisation of the pre-alloy, alignment of the powder in a magnetic field and pressing to a green formed body, sintering at 1040° to 1100° C. and subsequent annealing at 600° to 700° C., whereby one adds the oxygen as Al or Nd oxide or via the grinding and/or sintering atmosphere.

8 Claims, 4 Drawing Sheets

SINTER MAGNET BASED ON FE-ND-B

Sinter magnets of the Fe-Nd-B type are characterised at room temperature by especially high magnetic characteristic values: Their temperature stability—mainly the coercive field strength $H_{CJ}$—is, however, unsatisfactory and prevents the use of the magnets in temperature-stressed machines.

Therefore, for technical uses, it is necessary to improve the magnets to such an extent that their use up to 200° C. is possible in the case of strong counterfields. In order to achieve this, especially the coercive field strength of the magnets must be further improved and the temperature dependency of the coercive field strength are reduced in order to ensure still sufficient values at comparatively high temperatures.

One has already attempted to achieve this improvement by additions of further elements to the Fe-Nd-B alloy. Thus, with additions of Dy, Tb, Al and Nb, a clear improvement of the $H_{CJ}$ could be achieved.

Dy and Tb, as expensive, heavy rare earth metals, influence the crystal anisotropy of the $Fe_{14}Nd_2B$ phase and thus also the coercive field strength in favourable way.

From M. H. Ghandehari, Appl. Phys. Lett., 48 (8) 1986, pp. 548–550, it is known that by reaction sintering of $Fe_{77}Nd_{15}B_8$ with (in comparison with the pure elements the cheaper) oxides $Dy_2O_3$ and $Tb_4O_7$, the increase of $H_{CJ}$ achieved by addition of the corresponding amounts of the pure elements Dy and Tb is reduced. This allows an impairment of the positive action of the Dy or Tb addition by oxygen addition to be recognised.

Nb addition brings about separations in the $Fe_{14}Nd_2B$ grains which are to act as obstacles in the case of the domain wall movement. The cause of the influence of Al on $H_{CJ}$ has not yet been fully elucidated.

From the U.S. Pat. No. 4,588,439, it is further known that the resistance of rare earth metal-containing permanent magnets against corrosion is improved when the pre-alloy is ground in oxygen-containing atmosphere. Nothing is hereby reported regarding an improvement of the coercive field strength.

Therefore, the task forming the basis of the invention is to improve the coercive field strength in the case of sinter magnets of the type Fe-Nd-B and to reduce the temperature dependency thereof without having to add heavy rare earth metals, such as Dy and Tb.

According to the invention, this task is solved by a sinter magnet based on Fe-Nd-B which is characterised in that it consists of 25 to 50 wt. % Nd, 0.5 to 2 wt. % B, 0 to 5 wt. % Al, 0.5 to 3 wt. % O, remainder Fe and usual impurities and the oxygen content is adjusted by the addition of at least one Al and/or Nd oxide before the dense sintering.

Surprisingly, it has been shown that by introduction of oxygen in the form of Al and/or Nd oxide, there can be achieved not only a considerable increase of the coercive field strength but also a clear improvement of the temperature dependency of these properties.

Composition, production and properties of the sinter magnets according to the invention are described in more detail in the following in conjunction with the drawing.

Sinter magnets based on Fe-Nd-B normally already contain small amounts of oxygen as impurity, depending upon the production process. Thus, the oxygen content of the Fe-Nd-B pre-alloys normally produced as intermediate products for the production of sinter magnets usually amounts to about 0.02 wt. %. By the grinding of the pre-alloys, a further increase of the oxygen content can be obtained if this is not carefully excluded by maintenance of an inert atmosphere. This oxygen enriches in the case of the later liquid phase sintering in the liquid Nd-rich phase and can lead to the formation of new phases in the case of its solidification.

The invention now depends upon the recognition that, by the precise oxygen addition in the form of an Al or Nd oxide, especially of $Al_2O_3$ and/or $Nd_2O_3$, these phases can be so influenced that the sought-for improvement of the properties, as explained above, is achieved.

The oxides are expediently added to the pre-alloy Fe-Nd-B before or during the grinding, preferably already in powder form. The average particle size of the added $Al_2O_3$ preferably amounts to 0.5 to 0.05 μm. $Nd_2O_3$ is expediently first finely ground in an attritor and then added to the alloy present for the further grinding. In this way, an especially uniform distribution of the oxide grains in the powder mixture is achieved.

Figure 1:
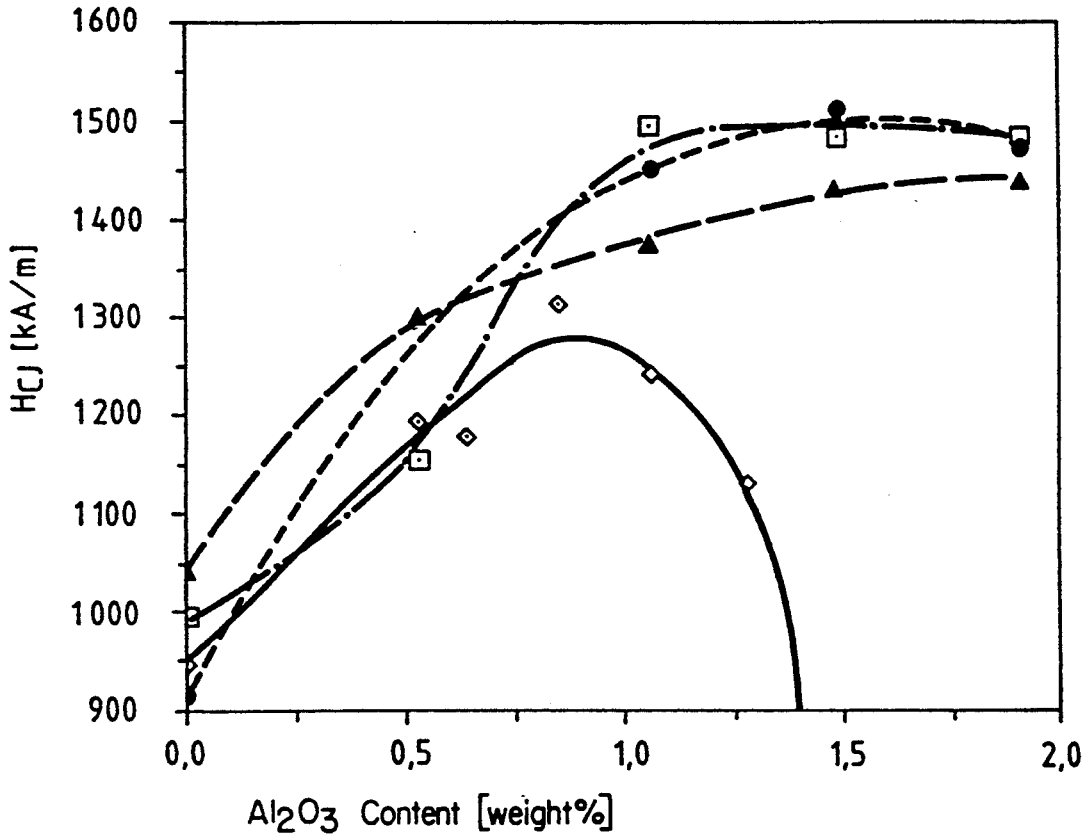
FIG. 1 a graphic illustration of the relationship between $H_{CJ}$ and the Al oxide content for 4 different Fe:Nd ratios.

In a preferred embodimental form of the invention, the sinter magnet contains 48 to 60 wt. % Fe, 38 to 50 wt. % Nd, 0.9 to 1.1 wt. % B and 0.1 to 2 wt. % $Al_2O_3$. Especially preferred are hereby compositions of the mentioned type which are obtained with pre-alloys, the Nd content of which lies between 18.5 and 25 atom % and the B content amounts to 6.0 to 7.0 atom %. It is herewith possible to increase the $H_{CJ}$, depending upon the Nd content of the pre-alloy, by 40 to 60% in comparison with the corresponding values without Al oxide addition. The increase of the coercive field strength and of its temperature stability by the $Al_2O_3$ addition is thereby the more marked, the higher is the Nd content. In FIG. 1 of the accompanying drawing is graphically illustrated the dependency of the coercive field strength of 4 different Fe-Nd-B magnets upon the $Al_2O_3$ content. On the lower limit of the above-given preferred range for the Nd content are achieved the best results with $Al_2O_3$ additions of up to 0.8%. However, at 20 atom % Nd content, up to the upper limit of the $Al_2O_3$ content of 2%, a further increase of the $H_{CJ}$ value can be achieved.

Figure 2:
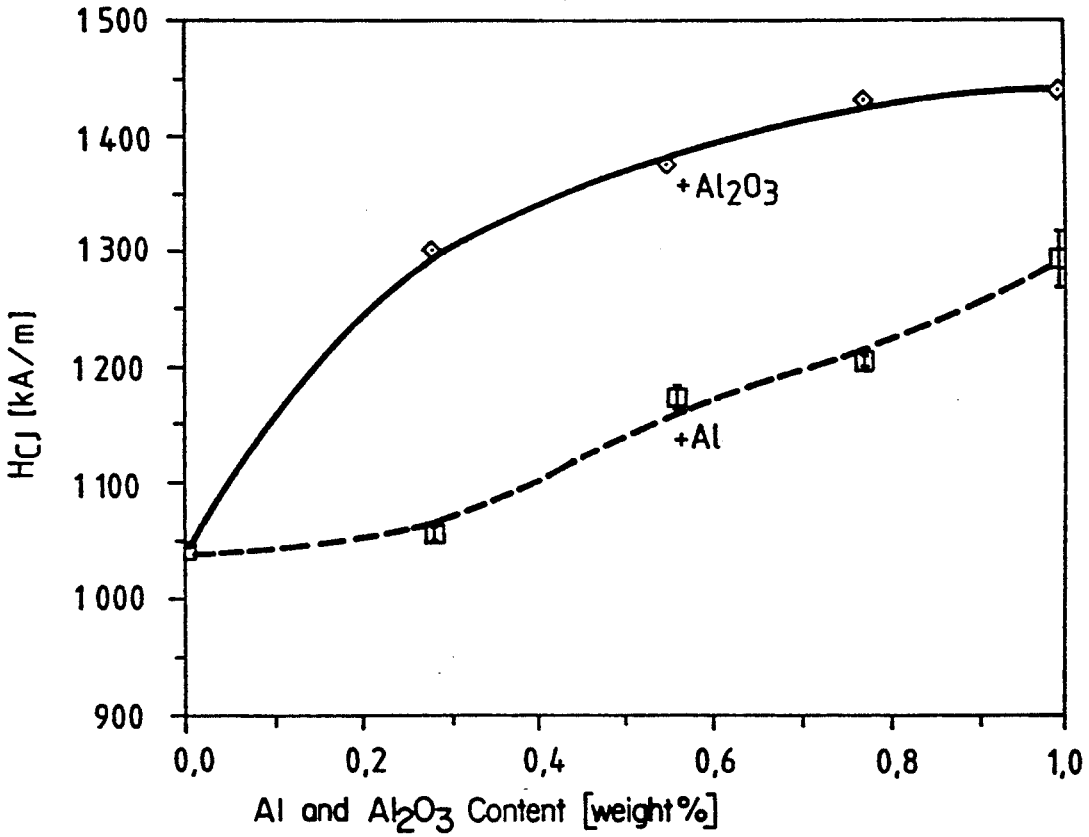
FIG. 2 a comparison of the $H_{CJ}$ values for a base alloy in dependence upon the addition as $Al_2O_3$ and as Al.

If, to the same magnets, not Al oxide but rather only aluminium is added, then one obtains substantially smaller increases of the coercive field strength, as is shown in FIG. 2. There is illustrated graphically the dependency of the coercive field strength for the alloy $Fe_{73.5}Nd_{20}B_{6.5}$ upon the Al content in comparison with a magnet which was obtained from the same pre-alloy in which, however, the Al was added in the form of $Al_2O_3$. The substantial improvement achieved according to the invention by $Al_2O_3$ addition in comparison with Al-containing magnets is evident therefrom.

Figure 3:
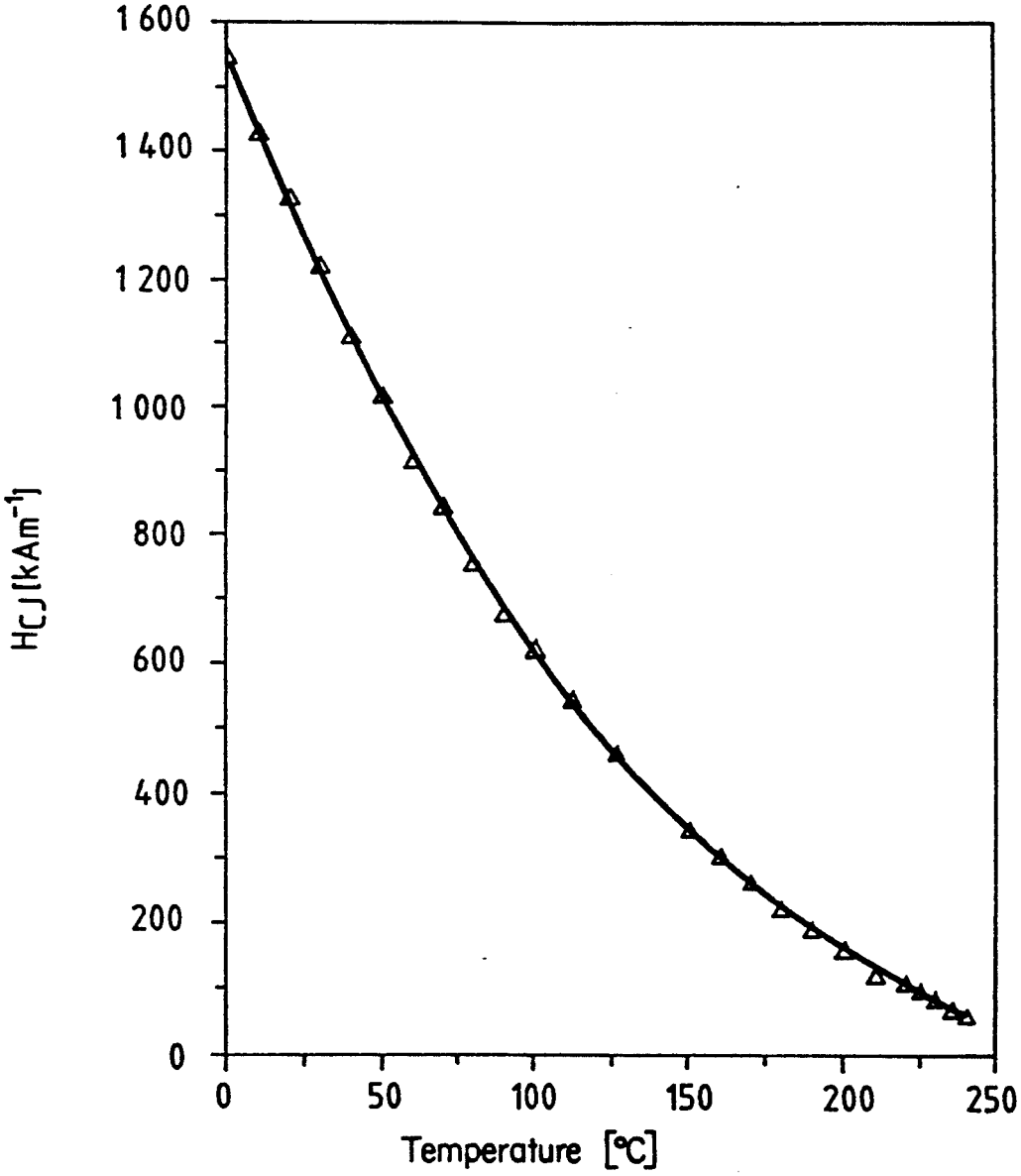
FIG. 3 the temperature dependency of $H_{CJ}$ of a sinter magnet according to the invention with $Al_2O_3$ addition.

The temperature dependency of the coercive field strength $H_{CJ}$ in the case of magnets according to the invention is substantially improved. For the special composition $Fe_{74.5}Nd_{19.5}B_{6.0}$+2 wt. % $Al_2O_3$, the temperature dependency is illustrated in FIG. 3.

Figure 4:
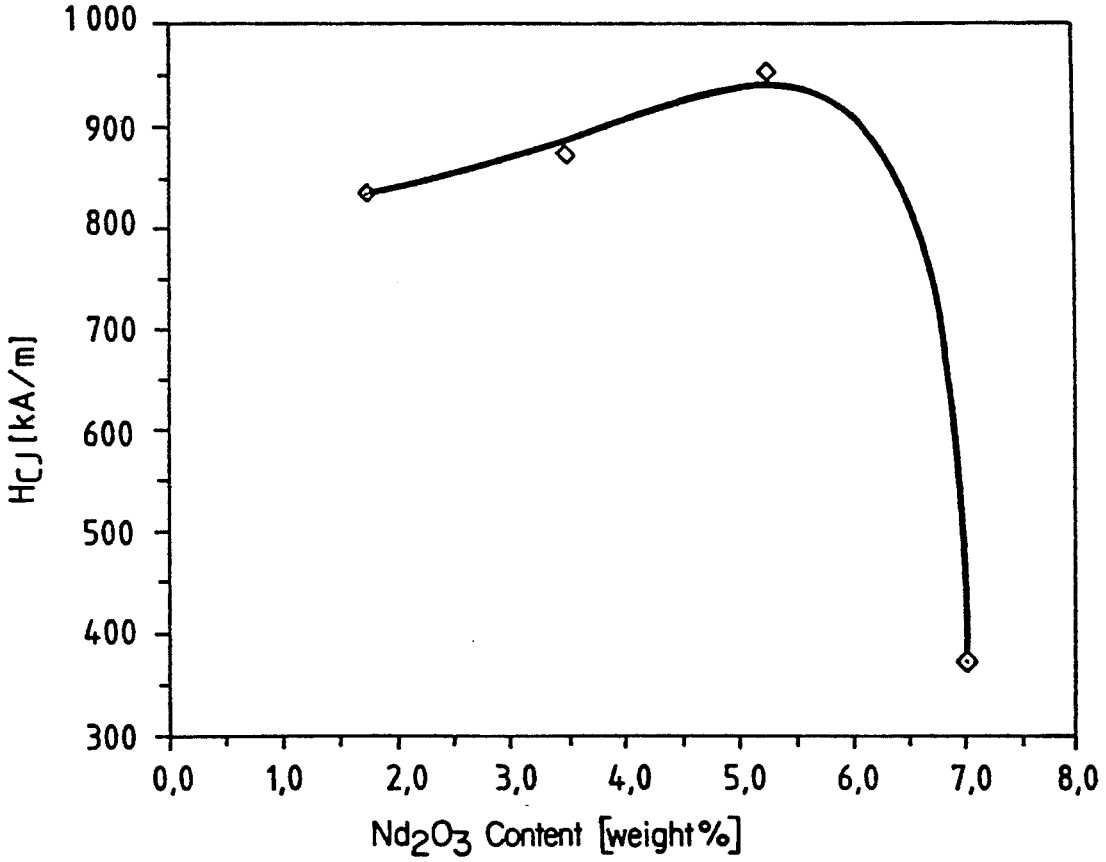
FIG. 4 a graphic illustration corresponding to FIG. 1 for a base alloy and $Nd_2O_3$ addition.

In a further preferred embodimental form of the invention, the sinter magnet contains 2 to 6.5% $Nd_2O_3$. FIG. 4 shows that, starting from a pre-alloy $Fe_{75}Nd_{18.5}B_6$, the addition of $Nd_2O_3$ gives an increase of $H_{CJ}$ in the given range of 2 to 6.5 wt. %, which amounts to up to 15%. If the $Nd_2O_3$ content exceeds the given upper limit, then the non-magnetic phase portions increase.

The production of the sinter magnets according to the invention takes place by a modification of the known production methods. This consists in the melting together of the pure components with formation of a pre-alloy, pulverisation of the pre-alloy, alignment of the powder in a magnetic field and pressing of the so-aligned powder to a green formed body, sintering of the formed body at a temperature between 1040° and 1100° C. and subsequent annealing at 600° to 700° C. According to the invention, such a process is now characterised in that one uses a composition of 25 to 50 wt. % Nd, 0.5 to 2 wt. % B, 0.5 to 3 wt. % O, 0 to 5 wt. % Al, remainder Fe and usual impurities, whereby one adds at least a part of the oxygen in the form of an Al and/or Nd oxide and mixes homogeneously before the production of the green body. Preferably, the addition amounts to 0.1 to 2% $Al_2O_3$ or 2 to 6.5% $Nd_2O_3$. Mixtures of these oxides can also be used.

The Al and/or Nd oxide, preferably in very finely powdered form, is added, in general, to the powdered pre-alloy and ground therewith in order to achieve a distribution as homogeneous as possible. The values illustrated in the Figures were obtained with magnets produced in this way which were ground for 30 minutes, sintered for 1 hour at 1060° C. and subsequently annealed for 1 hour at 600° C. The same improvements of the magnetic properties are achieved when, alternatively, Al and/or Nd oxide is added in the case of the melting of the pre-alloy or the oxygen is added via the grinding and/or sintering atmosphere.

Four sheets of drawings attached:

FIG. 1

Dependency of the coercive field strength of Fe-Nd-B magnets upon the $Al_2O_3$ content. To the different Fe-Nd-B pre-alloys (◈ $Fe_{74}N_{18.5}B_{6.5}$; ▲ $Fe_{73.5}Nd_{20}B_{6.5}$; ● $Fe_{71}Nd_{22.5}B_{6.5}$; ⊡ $Fe_{68.5}Nd_{25}B_{6.5}$), $Al_2O_3$ powder was added in the case of grinding $H_{CJ}$ [kA/m] plotted against $Al_2O_3$ content [wt. %]

FIG. 2

Dependency of the coercive field strength of $Fe_{73.5}Nd_{20}B_{6.5}$ magnets upon the Al content. In the case of the sample indicated with ⊡, Al was added in pure form in the case of the melting of the pre-alloy, in the case of sample indicated with ◈, in the case of the grinding as $Al_2O_3$. $H_{CJ}$ [kA/m] plotted against Al content [wt. %]

FIG. 3

Temperature dependency of $H_{CJ}$ of the alloy $Fe_{74.5}Nd_{19.5}B_{6.0}$ with 2 wt. % $Al_2O_3$ addition $H_{CJ}$ [kA/m$^{-1}$] plotted against temperature [°C.]

FIG. 4

Dependency of the coercive field strength of $Fe_{75}Nd_{18.5}B_{6.5}$ magnets upon the $Nd_2O_3$ content. The $Nd_2O_3$ powder was added in the case of grinding. $H_{CJ}$ [kA/m] plotted against $Nd_2O_3$ content [wt. %]

We claim:

1. An Fe-Nd-B sintered magnet having improved coercive field strength and decreased temperature dependency of the coercive field strength, said magnet consisting of the following components by weight percent: 38 to 50% Nd, 0.9 to 1.1% B, 0 to 5% Al, 0.5 to 3% O, 48–60% Fe and the remainder impurities;

wherein the magnet is produced from an Fe-Nd-B pre-alloy which, after being formed, is subjected to grinding and dense sintering and wherein the content of the oxygen component is adjusted by the addition of elemental oxygen during grinding and/or sintering of the pre-alloy or by the addition of 0.1 to 2 wt. % $Al_2O_3$, during formation of the pre-alloy and/or grinding of the pre-alloy.

2. A process for the production of an Fe-Nd-B sintered magnet consisting of the following components by weight percent: 25 to 50% Nd, 0.5 to 2% B, up to 5% Al, 0.5 to 3% O, 48–60% Fe and the remainder impurities, said method comprising the steps of:

(a) forming an Fe-Nd-B pre-alloy;
(b) grinding the pre-alloy to a powder;
(c) aligning the powder in a magnetic field;
(d) pressing the powder to a green body;
(e) sintering the green body at a temperature of from 1040° to 1100° C.;
(f) annealing the sintered body at a temperature of from 600° to 700° C., wherein at least a portion of the content of the oxygen component is adjusted by the addition of $Al_2O_3$ during formation of the pre-alloy and/or grinding of the pre-alloy.

3. The process of claim 2 further characterized in that at least a portion of the oxygen component is adjusted by the addition of $Al_2O_3$ and the oxygen component is further adjusted by the addition of elemental oxygen during the grinding of the pre-alloy and/or sintering of the green body.

4. The process of claim 3 wherein at least a portion of the oxygen component is provided by the addition of 0.1 to 2 wt. % $Al_2O_3$.

5. The process of claim 4 wherein the $Al_2O_3$ is added during step (a).

6. The process of claim 4 wherein the $Al_2O_3$ is added during step (b).

7. The process of claim 3 further characterized in that the oxygen component is further adjusted by the addition of oxygen gas to the grinding atmosphere of step (b), or the sintering atmosphere of step (e) or to both of the grinding and sintering atmospheres.

8. The Fe-Nd-B sintered magnet of claim 2 wherein at least a portion of the oxygen component is further adjusted by the addition of elemental oxygen during the grinding of the pre-alloy and/or sintering of the green body.

* * * * *